US007227562B2

(12) United States Patent
Asuwa et al.

(10) Patent No.: US 7,227,562 B2
(45) Date of Patent: Jun. 5, 2007

(54) ELECTROPHOTOGRAHIC APPARATUS

(75) Inventors: Kenji Asuwa, Toride (JP); Toru Miyasaka, Tsuchiura (JP); Taichiro Yamashita, Tsuchiura (JP); Masahiro Yagi, Kashiwa (JP); Shintaro Yamada, Chiyoda (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 579 days.

(21) Appl. No.: 10/694,813

(22) Filed: Oct. 29, 2003

(65) Prior Publication Data

US 2004/0085431 A1 May 6, 2004

(30) Foreign Application Priority Data

Oct. 31, 2002 (JP) ..... 2002-317116
Jul. 31, 2003 (JP) ..... 2003-204930

(51) Int. Cl.
*G03G 15/01* (2006.01)

(52) U.S. Cl. ..... 347/138; 399/107; 347/263; 347/152; 347/245

(58) Field of Classification Search ..... 347/115, 347/117, 118, 129, 130, 13, 152, 263, 245, 347/138
See application file for complete search history.

(56) References Cited

U.S. PATENT DOCUMENTS 6,381,428 B1 * 4/2002 Yamamoto et al. ..... 399/116
6,477,348 B2 * 11/2002 Miyamoto et al. ..... 399/299
6,798,430 B2 * 9/2004 Sato ..... 347/115
6,895,211 B2 * 5/2005 Yamashita et al. ..... 399/400

FOREIGN PATENT DOCUMENTS

JP A-5-11584 1/1993
JP A-8-137179 5/1996
JP A-11-167278 6/1999
JP A-11-344858 12/1999
JP 2001-002330 * 1/2001
JP A-2001-134042 5/2001
JP A-2001-296713 10/2001
JP A-2001-356548 12/2001

* cited by examiner

*Primary Examiner*—Huan Tran
(74) *Attorney, Agent, or Firm*—Antonelli, Terry, Stout & Kraus, LLP.

(57) ABSTRACT

Provided is a small-sized electrophotographic apparatus for which maintenance such as disposal of a jam of sheets, replacement of consumables including toner, or replacement of components to be periodically replaced can be facilitated.

Thus, there is provided a tandem type electrophotographic apparatus using an intermediate transfer belt, in which photosensitive drums are arranged in a vertical one row, the intermediate transfer belt is located on one side of the row of the photosensitive drums, the developing means are located on the other side of the row of the photosensitive drums, a transfer means for transfer a toner image from the intermediate transfer belt onto a recording medium is located above the row of the photosensitive drums, a recording medium conveying path composed of a vertical conveying path (a front opening door) for conveying a recording medium fed from the recording medium supply means, outside of the developing means and substantially in parallel with the intermediate transfer belt, a curved part and a horizontal conveying path for conveying the recording medium up to a transfer means in a substantially horizontal direction, and a fixing means for fixing a toner image transferred onto the recording medium is incorporated in the horizontal conveying path (a top surface opening door), downstream of the transfer means.

16 Claims, 13 Drawing Sheets

DURING OPERATION

DURING REPLACEMENT

ELECTROPHOTOGRAHIC APPARATUS

BACKGROUND OF THE INVENTION

The present invention relates to an image forming apparatus such as a copying machine, a printer, a facsimile system which forms a color image with the use of electrophotography, and in particular, to an electrophotographic apparatus for forming a color image with the use of a plurality of color toners.

With the electrophotography, a light beam is projected from an exposure means onto a photosensitive medium which is uniformly charged, so as to form a latent image corresponding to image data, and toner is stuck to the latent image on the photosensitive medium so as to develop the latent image. The thus obtained toner image is transferred onto and fixed on a recording medium.

It is noted here that explanation will be hereinbelow made so as to use the recording medium as a sheet. However, the recording medium should not be limited to the sheet alone but there may be used a sheet-like recording medium made of any of various materials including plastic.

In order to form a color image, a plurality of color toners such as yellow Y, magenta M, cyan C and black K are superposed one upon another so as to form the image.

There are two kinds of color image forming systems, such as a repeated developing system in which development is repeated on a single photosensitive medium with color toners so as to form a color image, and a simultaneous developing system in which developments are simultaneously carried out on a plurality of photosensitive mediums with color toners so as to form a color image.

The repeated development system is the one in which a single photosensitive medium is used for forming a color image, and as typical examples, there are a transfer drum system and an intermediate transfer medium system.

In the transfer drum system, a plurality of developing means for developing images with different color toners are arranged around a photosensitive medium, together with a transfer drum for winding a recording medium thereon, and different color images formed on the photosensitive medium are transferred one by one onto the recording medium. This operation is repeated for the different color images which are superposed one upon another on a recording medium so as to obtain a color image.

In the intermediate transfer medium system, a plurality of developing means for developing images with different color toners are arranged around a photosensitive medium, together with an intermediate transfer medium, and toner color images formed on the photosensitive medium are transferred one by one onto the intermediate transfer medium. This transfer is repeated for different color images so as to superpose these images on the intermediate transfer medium in order to form a color image which is then transferred onto a medium on which the color image is fixed.

The transfer drum system is apt to cause the quality of an obtained color image to be affected by a kind of sheets since different color toner images are directly superposed on a recording medium, that is, the intermediate transfer medium system is more excellent in view of the formation of a color image on any of various kinds of sheets including a cardboard.

However, even in the intermediate transfer medium system, since different toner color images of, for example, yellow Y, magenta M, cyan C and black K are formed one by one on the photosensitive medium, and are then transferred onto the intermediate transfer medium, being superposed one upon each other, a time which is four times as long as that required for formation of a monochromatic image is required.

The simultaneous developing system simultaneously forms color toner images respectively on a plurality of photosensitive mediums for respective different colors, and transfers the different color toner images in association with a conveyance of a sheet so as to form a color image. Thus, this developing system is also called as a tandem system.

The tandem system incorporates an image forming means including a photosensitive medium, a charging means, an exposure means, a developing means and a cleaner means for each color, and accordingly, four image forming means are required for forming a color image with color toners of yellow Y, magenta M, cyan C and black K.

In the tandem system, different toner color images are formed by four independent image forming means, simultaneously in parallel with each other, and are then transferred onto an intermediate transfer medium or a sheet. In the tandem system, since different toner color images are simultaneously superposed one upon another, a color image can be formed by a time nearly equal to that required for formation of a monochromatic image, and accordingly, this system is preferable for high speed printing of a color image.

It is noted that the tandem system is sorted into a direct transfer system and an intermediate transfer medium system in view of a diagnostic criteria whether different color images are directly superposed with one other on a recording medium or are superposed with one other a transfer medium. The intermediate transfer medium system is advantageous for different kinds of sheets, similar to the repeated development system.

These years, there have been increased demands for colorization of documents in offices and accordingly, color printers have been rapidly spread in use. Further, it has been desired to increase the printing speed, and accordingly, tandem system color printers have been spot-lighted.

However, since the tandem system color printer inevitably incorporates four image forming means, the miniaturization of the printer is difficult, that is, it has a size which is relatively larger than that of a repeated development system color printer.

In particular, in a tandem type system color printer in which image forming means are horizontally laid as conventionally usual, an increased size of the printer causes its occupied floor area to be larger in the case of installation thereof in an office.

Thus, it has been proposed a tandem system color printer in which image forming means are arranged in a vertical direction in order to decrease the size of the printer and to reduce the occupied floor area thereof.

It has been known a tandem system color printer in which a laser light source is used as an exposure means, and four image forming means are arranged in a vertical direction along a straight part of an intermediate transfer medium (as disclosed, for example, JP-A-2001-134042). In this tandem system color printer, a laser exposure means is mounted so as to be stationary, and photosensitive drums are mounted on a common member so as to be grouped in one unit in order to ensure a high degree of accuracy. Developing means are removably mounted in front of the printer.

A tandem system color printer in which LED arrays are used as the exposure means, and four image forming means are stacked in a vertical direction along a straight part of an intermediate transfer medium has been also known (as disclosed in JP-A-2001-356548). In this tandem system color printer, the LED arrays are mounted to be stationary so as to ensure a high degree of accuracy. A process cartridge in which the photosensitive drums and the developing means are integrally incorporated is removably mounted in front of the printer.

It is noted that the image forming means are arranged in a vertical direction in the printer disclosed in JP-A-2001-134042 or JP-A-2001-356548 in order to decrease the size of the printer and to reduce the occupied floor area.

In the printer disclosed in JP-A-2001-134042, the developing means can be removed in front of the printer. However, a jam of sheets should be removed in rear of the printer, and accordingly, its manipulatability is unsatisfactory.

In the printer disclosed in JP-A-2001-356548, a sheet tray is set in the upper part of the printer, and further, sheets are discharged onto a discharge tray in the upper part of the printer. In this configuration, a process cartridge in which a photosensitive drum and a developing means are integrally incorporated can be removed in front of the printer, and a jam of sheets can be removed at the top surface of the printer. However, since the sheet tray overhangs at the top surface of the printer, the occupied floor area is increased. Further, the capacity of supply of sheets cannot be increased in comparison with a printer in which a sheet tray is set in the lower part of the printer. It is noted that this document also discloses an example in which a sheet tray is set in the lower part of a printer. Even in this configuration, the process cartridge can be removed in front of the printer. However, a jam of sheets should be removed in rear of the printer, and accordingly, its manipulatability is low.

Thus, in the tandem system color printer, such a configuration that the image forming means are arranged in a vertical direction is used in order to miniaturize the printer, and in the case of selection of an intermediate image transfer medium system in order to accept various kinds of sheets, the manipulatability for replacement of toners and removal of a jam of sheet becomes lower.

OBJECT AND SUMMARY OF THE INVENTION

An object of the present invention is to provide a small-sized electrophotographic apparatus which can facilitate maintenance thereof, including removal of a jam of sheets, replacement of consumables such as toners, replacement of components such as a photosensitive drum.

To the end, according to the present invention, there is provided an electrophotographic apparatus comprising a plurality of image forming means each including a photosensitive drum having an outer surface formed thereon with a photosensitive layer, a charging means for charging the photosensitive layer to a photosensitive potential, an exposure means for exposing the photosensitive layer in accordance with image data so as to form thereon a latent image and a developing means for causing toner to stick to the latent image on the photosensitive drum so as to form a toner image, the plurality of image forming means being stacked one upon another along a straight part of an endless intermediate transfer belt or an endless medium conveying belt which is stretched being wound around a drive roller and a driven roller and is rotated, the photosensitive drums making contact with the outer peripheral surface of the straight part of the belt, toner images formed on the plurality of photosensitive drums being transferred through the intermediary of an intermediate transfer belt or directly onto the belt in order to form a color image, wherein the photosensitive drums are arranged in one vertical row, the intermediate transfer belt is arranged on one side of the row of the photosensitive drums while the developing means are arranged on the other side of the row of the photosensitive drums, a recording medium supply means is arranged below the row of the photosensitive drums while a transfer means for transferring the color image onto a recording medium from the intermediate transfer belt is arranged above the row of the photosensitive drums, and a recording medium conveying path composed of a vertical conveying path for conveying the recording medium fed from the recording medium supply means in substantial parallel with the straight part of the intermediate transfer belt outside of the image forming means, a curved part and a horizontal conveying path for conveying the recording medium to the transfer means in a substantially horizontal direction is provided.

To the end, further according to the present invention, there is provided an electrophotographic apparatus comprising a plurality of image forming means each including a photosensitive drum having an outer surface formed thereon with a photosensitive layer, a charging means for charging the photosensitive layer to a photosensitive potential, an exposure means for exposing the photosensitive layer in accordance with image data so as to form thereon a latent image and a developing means for causing toner to stick to the latent image on the photosensitive drum so as to form a toner image, the plurality of image forming means being stacked one upon another along a straight part of an endless intermediate transfer belt or an endless medium conveying belt which is stretched being wound around a drive roller and a driven roller and is rotated, the photosensitive drums making contact with the outer peripheral surface of the straight part of the belt, toner images formed on the plurality of photosensitive drums being transferred through the intermediary of an intermediate transfer belt or directly on to the belt in order to form a color image, wherein the photosensitive drums are arranged in one vertical row, the intermediate transfer belt is arranged one side of the row of the photosensitive drums while the developing means are arranged on the other side of the row of the photosensitive drums, a recording medium supply means is arranged below the row of the photosensitive drums while a transfer means for transferring the color image onto a recording medium from the intermediate transfer belt is arranged above the row of the photosensitive drums, a recording medium conveying path composed of a vertical conveying path for conveying the recording medium fed from the recording medium supply means in substantial parallel with the straight part of the intermediate transfer belt, outside of the developing means, a curved part and a horizontal conveying path for conveying the recording medium to the transfer means in a substantially horizontal direction is provided, and a fixing means provided in the horizontal conveying path, downstream of the transfer means, for heating the toner image transferred onto the recording medium so as to fix the toner image on the recording medium.

A second recording medium supply means is provided upstream of the horizontal conveying path, substantially above the curved part, and an auxiliary sheet discharge port is formed downstream thereof.

The vertical conveying path incorporates a front opening door for exposing the conveying path, and the horizontal conveying path incorporates a top opening door for exposing the conveying path.

Further, the vertical transfer path, and the curved part and the horizontal path may have an inverted L-like opening door for exposing the conveying path.

The developing means incorporates a developing unit front end part including a developing roller making contact with the photosensitive drum so as to be rotated, for forming a thin toner layer on the outer surface of the photosensitive drum, a supply roller for feeding toner onto the outer surface of the developing roller, and a toner regulating blade made into line-like contact with the outer peripheral surface of the developing roller at a predetermined pressure so as to form a thin toner layer on the outer surface of the developing roller, and a toner accommodation part coupled to the developing unit front end part, for accommodating toner. The developing unit front end part and the toner accommodation part constitute an integrated developing cartridge which can be removed from the opening door for exposing the vertical conveying path.

The developing means incorporates a developing unit front end part including a developing roller making contact with the photosensitive drum so as to be rotated, for forming a thin toner layer on the outer surface of the photosensitive drum, a supply roller for feeding toner to the developing roller and a toner regulating blade made into line-like contact with the outer peripheral surface of the developing roller with a predetermined pressure, for forming a thin toner layer on the outer surface of the developing roller, and a toner accommodation part coupled to the developing unit front end part, for accommodating therein toner, the developing unit front end part and the toner accommodation part being formed so as to be separatable from each other. Thus, the toner accommodation part alone can be removed from the opening door which can expose the vertical conveying path.

The exposure means incorporates LEDs.

In the case of formation of an integrated unit in which at least a plurality of photosensitive drums which are mounted to a common support member, this unit can be removed upward.

The intermediate transfer belt can also be removed upward.

In the case of such an integral unit that an intermediate transfer belt and a plurality of photosensitive drums are mounted to a common support member, the unit can be removed upward.

Further, in the case of such an integral process cartridge that the developing means is composed of a developing unit front end part including a developing roller making contact with a photosensitive drum and rotating therewith, for forming a thin toner layer on the outer surface of the photosensitive drum, a supply roller for feeding toner to the developing roller and a toner regulating blade made into line-like contact with the outer surface of the developing roller with a predetermined pressure so as to form a thin toner layer on the outer surface of the developing roller, and a toner accommodation part coupled to the developing unit front end part, for accommodating therein toner, the integral process cartridge composed of the developing unit front end part, the toner accommodation part and the photosensitive drum can be removed from the opening door side which exposes the vertical conveying path.

In this case, the exposure means incorporates a laser beam.

The intermediate transfer belt can be removed upward.

In either of the above-mentioned electro-photographic apparatuses, a fixing means can be removed upward.

In either of the above-mentioned electro-photographic apparatuses, an accommodation space for accommodating at least one of a power unit and a drive circuit is incorporated outside of the intermediate transfer belt.

According to the present invention, the photosensitive drums are arranged in one vertical row, and the intermediate transfer belt stretched in a vertical direction is arranged on one side of the row while the developing means is arranged on the other side thereof. Further, the sheet tray as a recording medium supply means is located below thereof, and the transfer means for transferring a toner image from the intermediate transfer medium onto a recording medium is located above the intermediate transfer medium.

The sheet conveying path is formed so that a sheet fed from the sheet supply means passes at first on the developing means side of the row of the photosensitive drums, that is, in front of the apparatus, and is conveyed substantially in parallel with the direction of the row of the photosensitive drums, being directed toward the transfer means after passing through the curved part, and is then conveyed in a substantially horizontal direction.

In this arrangement, a front opening door is provided including the sheet conveying path, thereby it is possible to dispose a jam of sheets in front of the apparatus.

In the case of the developing means composed of a developing unit front part incorporating a developing roller making contact with a photosensitive drum so as to be rotated, for forming a thin toner layer on the outer surface of the photosensitive drum, a supply roller for feeding toner to the developing roller and a toner regulating blade made into line-like contact with the developing roller with a predetermined pressure, for forming a thin toner layer on the outer surface of the developing roller, and a toner accommodation part coupled to the developing unit front part, for accommodating toner so as to form an integral developing cartridge, the developing cartridge can be removed from the opening door side.

Further, with the provision of a top surface opening door, since the sheet conveying path can be exposed around the transfer means when the top surface opening door is opened, not only a jam of sheets can be disposed on the top side of the apparatus, but also the fixing means and the intermediate transfer belt can be removed upward.

By mounting a plurality of photosensitive drums to a common support member so as to constitute a unit body, the photosensitive medium can be removed upward.

By mounting photosensitive drums to a support member common to an intermediate transfer belt so as to form a unit body, similar technical effects can be obtained.

In a sheet conveying path in a part around the transfer means where it extends in a substantially horizontal direction, by arranging a fixing means so that the sheet transfer path can be held in a substantially horizontal direction, adjacent to the transfer means on the downstream side thereof, an accommodation space for accommodating a power source unit and a drive circuit can be ensured, thereby it is possible to miniaturize the electrophotographic apparatus due to a high density mounting.

By arranging a manual sheet feed tray as a second recording medium supply means on the upstream side of a substantially horizontal sheet conveying path, and by arranging an auxiliary sheet discharge port on the downstream side thereof, a sheet conveying path which is substantially straight from the supply of a sheet to the discharge of the sheet is formed, and various kinds of sheets including thick sheets can be used.

The present invention should not be limited to such a configuration that a developing cartridge in which the developing unit front end part is integral with the toner accommodation part is used. The present invention can be applied, similarly to a configuration in which the developing unit front part and the toner accommodating part can be separated from each other so as to allow the toner accommodation part alone to be replaced with another one.

Further, the present invention can be applied to such a configuration that the developing unit front end part, the toner accommodation part and the photosensitive drum constitute an integral process cartridge which can be removed on the front door opening side.

Other objects, features and advantages of the invention will become apparent from the following description of the embodiments of the invention taken in conjunction with the accompanying drawings.

DETAILED DESCRIPTION OF THE INVENTION

Explanation will be hereinbelow made of preferred embodiments of the present invention with reference to FIGS. 1 to 14.

Figure 1:
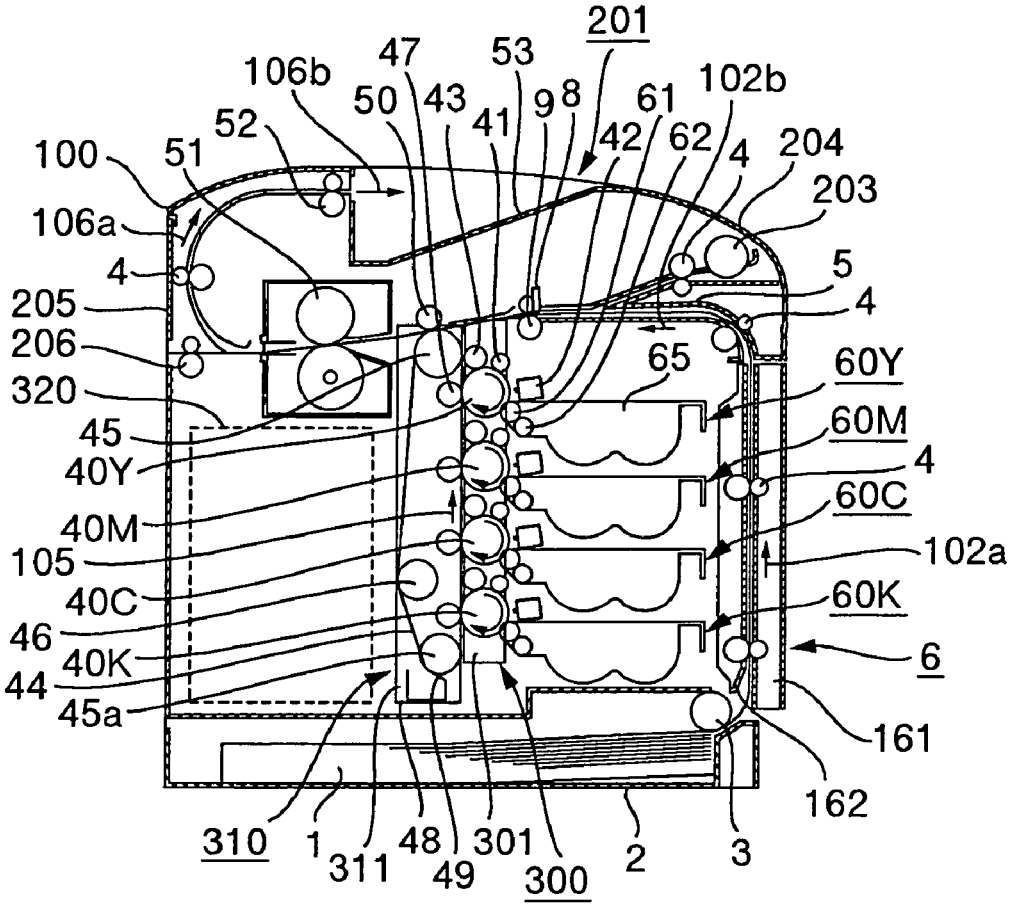
FIG. 1 is a sectional view illustrating an entire configuration of an embodiment 1 of an elecrophotographic apparatus according to the present invention.

FIG. 1 is a sectional view illustrating an entire configuration of an embodiment 1 of the electrophotographic apparatus according to an elctrophotographic apparatus according to the present invention.

The electrophotographic apparatus in the first embodiment is composed of a casing 100, a sheet cassette 2, a sheet separating means 3, a conveying means 4, a sheet conveying path 5, a front opening door 6, a sheet position detecting means 8, registration rollers 9, photosensitive drums 40, charging means 41, exposure means 42, cleaner means 43, an intermediate transfer belt 44, a drive roller 45, a tension regulating roller 46, a first transfer roller 47, a transfer cleaning means 48, a cleaning blade 49, a second transfer roller 50, a fixing means 51, a sheet discharge roller 52, a sheet discharge tray 53, developing means 60, developing rollers 61, supply rollers 62, toner accommodation parts 65, image forming means 70, a front side opening door 161, a rear side opening door 162, a top surface opening door 201, a sheet separating roller 203, a manual sheet feed tray 204, an auxiliary sheet discharge port 205, a conveying means 206, a photosensitive unit 300, an intermediate transfer belt unit 310, a support member 311, an accommodating space 320 for a power source and a drive circuit.

The sheet cassette 2 is located in the bottom part of the casing 100 so as to be drawable in front thereof in order to accommodate sheets. The sheet separating means 3 is located in an end part of the sheet cassette, near to the front opening door 6, so as to separate a plurality of printing sheets 1 set in the sheet cassette 2, from one another, one by one.

The conveying means 4 is composed of rubber rollers and the like, for conveying sheets 1 separated one by one in a direction of an arrow 102 along the conveying path 5 incorporating a sheet conveying guide at a predetermined speed, and is extended from a contact point between the sheet separating means 3 and the sheet cassette 2 as a start point, to the discharge roller 52 by way of the drive roller 45 and the second transfer roller 50.

The front opening door 6 is located in front of the casing 100, and is adapted to be opened forward around the lower end side as a fulcrum.

The sheet position detecting means 8 is located on the conveying path 5 on the upstream side of the registration rollers 9, for detecting a position of a sheet. The sheet position detecting means 8 may be one of a reflected light detecting type for detecting a variation in volume of light reflected from the surface of a sheet 1, a transmitted light detection type for detecting a variation in volume of received light when a sheet 1 passes between a light emitting element and a light receiving element, a lever detecting type for detecting a contact between a lever and a leading end of a sheet, and the sheet position detecting means 8 detects a leading end of a sheet which has comes to the sheet position detecting means 8 so as to deliver a sheet position signal. A pair of registration rollers 9 are located in the conveyer path, adjacent to the second transfer roller 50 on the side of the transfer roller near to the sheet separating means 3.

The image forming means 70 for yellow Y, magenta M, cyan C and black K, are stacked one upon another in the mentioned order along the intermediate transfer belt 44 on the side near the front opening door 6.

The endless intermediate transfer belt 44 is stretched in a loop-like manner between the drive roller 45 and a idle roller 45*a*. The drive roller 45 is located in the center upper part of the casing 100, having its axis in parallel with the axis of the rotating fulcrum 7. The driven roller 45*a* is located below the drive roller 45, having its axis in parallel with the axis of the drive roller 45. The tension regulating roller 46 is made into contact with the intermediate transfer belt 44 on the inside side thereof remote from the front opening door 6.

The transfer cleaning means 48 is opposed to the idle roller 45*a*, the intermediate transfer belt 44 being interposed therebetween. The transfer cleaning means 48 incorporates the cleaning blade 49 which is located so as to make, at its one end, contact with the outer peripheral surface of the intermediate transfer belt 49 with a predetermined pressure, for scraping off toner remaining on the outer peripheral surface thereof. The toner which has been scraped off is accumulated in a container in the transfer cleaning means 48.

It is noted that a cleaning roller may be used for scraping off toner remaining on the outer peripheral surface of the intermediate transfer belt 44, in stead of the cleaning blade 49 in the embodiment 1.

The second transfer roller 50 is located making contact with the outer peripheral surface of the drive roller 45, having its axis in parallel with the axis of the drive roller 45. A sheet 1 conveyed in the direction of the arrow 102 is made into contact with the intermediate transfer belt 44 by the second transfer roller 50 so as to transfer a toner image formed on the intermediate transfer belt 44 onto the surface of the sheet 1.

The fixing means 51 is provided in the conveying path, on the side of the second transfer roller 50, near to the sheet discharge tray 53. The fixing means 51 incorporates therein a heating means such as a nichrome wire or a halogen lamp, so as to heat the toner on the sheet 1 up to a temperature at which the toner is melted, and then, it applies a predetermined pressure to the melted toner for fixing the same on the sheet. The fixing means 51 is provided on the sheet discharge side with curved guides for holding the sheet at its opposite surfaces so as to convey the sheet 1 along the conveying path 5.

A pair of discharge rollers 52 are located on the side of the sheet discharge tray 53, remote from the front opening door 6, having its axis in parallel with the axis of the rotating fulcrum 7, and having their outer peripheral surfaces made into contact with each other. The discharge roller 52 discharges the sheet having been conveyed, outside of the apparatus.

The sheet discharge tray 53 in the upper part of the casing 100 holds therein sheets discharged outside of the apparatus from the discharge rollers 52. The top surface opening door 201 is opened rearward around a rotating fulcrum, as a rotating center, having its axis laid horizontally.

Figure 2:
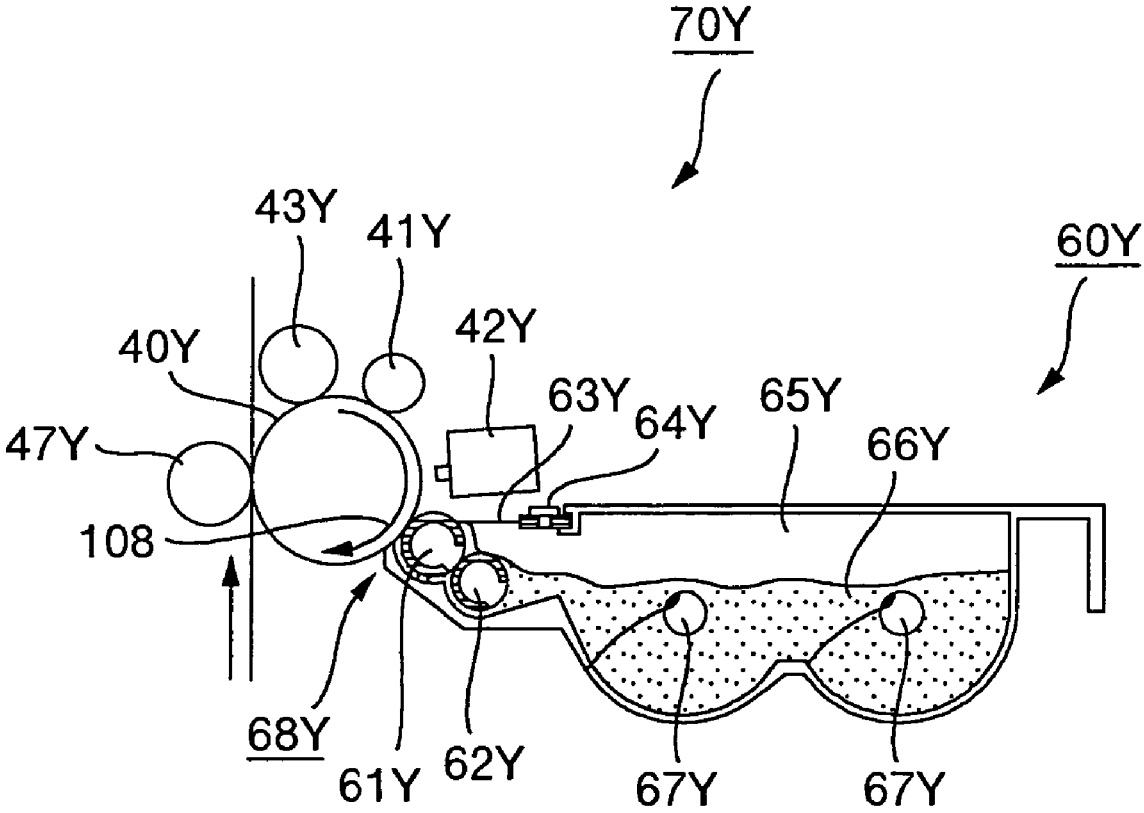
FIG. 2 is a sectional view illustrating a configuration of a main part of the embodiment 1.

FIG. 2 is a sectional view illustrating a configuration of a main portion of the apparatus in the embodiment 1.

There are required four image forming means 70 in order to obtain a color image, but FIG. 2 shows only one image forming means 70 for yellow Y. Since the four image forming means 70 for yellow Y, magenta M, cyan C and black K have configurations identical with one another, explanation will be made of the configuration of the yellow image forming means 70Y as a representative example.

The yellow image forming means 70Y includes a photosensitive drum 70Y, a charge means 41Y, an exposure means 42Y, the developing means 60Y, and the cleaner means 43Y and the first transfer roller 47Y. The photosensitive drum 40Y is formed on a cylinder coated over its outer surface with a photosensitive organic thin film or selenium or the like, on which a latent image and a toner image are formed. The photosensitive drum 40Y is located having its axis in parallel with the axis of the drive roller 45, and is rotated with its outer peripheral surface making contact with the outer peripheral surface of the intermediate transfer belt 44 on the side near the front opening door 6.

The charge means 41Y is formed of a conductive rubber roller or the like, and is applied thereto with a voltage of about, for example, 2 kV in order to charge the outer surface of the photosensitive drum 40Y up to a predetermined voltage.

The exposure means 42Y includes, for example, LEDs arranged in one row widthwise of the photo-sensitive medium, and is located on the downstream side of the cleaner 43Y in the rotating direction of the photosensitive drum 40Y, being spaced from the outer surface of the photosensitive drum 40Y by a predetermined focal distance F with its irradiation being directed toward the outer peripheral surface of the photosensitive drum 40Y. The LED array includes LEDs having a number from 600 to 1,200 per inch (25.4 mm) for forming a latent image on the outer peripheral surface of the photosensitive drum 40Y.

The cleaning means 43Y is located on the downstream side of the first transfer roller 47Y in the rotating direction of the photosensitive drum 40Y, having its axis in parallel with the axis of the photosensitive drum 40Y, and having its outer peripheral surface made into contact therewith.

The developing means 60Y is composed of a toner accommodation part 65Y for accommodating therein yellow toner 66Y, and a developing unit front end part 68Y formed on the photosensitive drum 40Y side of the toner accommodation part 65Y and incorporating therein the supply roller 62Y and also incorporating the toner regulating blade 63Y. The toner accommodation part 65Y incorporates toner agitating means 67Y for agitating the toner 66Y so as to feed the toner 66Y from the supply roller 62Y to the developing roller 61.

In this developing means 60Y, the outer peripheral surface of the developing roller 61Y which is incorporated in parallel with the photosensitive drum 40Y, with a predetermined space from the outer peripheral surface of the photosensitive drum 40Y is made into contact with the outer peripheral surface of the photosensitive drum 40Y on the downstream side of the exposure means 42Y in the rotating direction of the photosensitive drum 40Y, and the yellow toner 66Y is accommodated therein.

The developing means 60Y can be easily pulled out straightforward in the direction of the arrow 104, and can be also reinstalled after the front opening door 6 shown in FIG. 1 is opened.

The developing roller 61Y is composed of a core made of metal such as stainless steel, and a conductive elastic film formed on the outer surface of the core, having a conductivity of about $10^3$ to $10^9$ Ω.cm and made of urethane rubber, silicon rubber or the like. The outer surface of the photosensitive drum 40Y is rotated in the direction of the arrow 108, identical with that of the photosensitive drum 40Y.

The developing means 60Y incorporates therein the supply roller 62Y in parallel with the developing roller 61Y, the outer surface of the supply roller being made into contact with the outer peripheral surface of the developing roller 61Y.

The outer surface of the supply roller 62Y is made of porous sponge rubber, and is made into contact with the developing roller 61Y so as to be rotated in the same direction as that of the latter at the contact point, for supplying the toner 66Y to the developing roller 61Y.

The toner regulating blade 63Y is formed of a leaf spring having a stationary end side fixed to a housing for the developing means 60Y, and a free end side made into line-like contact with the developing roller 61Y along the mother line of the developing roller 61Y. The free end of toner regulating blade is made into contact with the outer peripheral surface of the developing roller 61Y with a predetermined pressure, and slides on the surface thereof as the developing roller 61Y is rotated so as to charge the toner and to form a thin toner layer having a predetermined thickness on the outer surface of the developing roller 61Y.

The toner regulating blade 63Y is located so that a straight line connecting the stationary end thereof and the contact point thereof to the developing roller 61 is laid along a norm line standing on the outer surface of the intermediate transfer belt, in a section which is cut by a plane orthogonal to the axis of the developing roller 61.

This straight line becomes ideal if it is orthogonal to the outer surface of the intermediate transfer belt 44, and the angle between this straight line and the normal line standing on the outer surface of the intermediate transfer belt 44 is preferably be not grater than 10 deg, the smaller this angle, the smaller the size occupied by the toner regulating blade 63 in the stacking direction of the image forming means 70. Thus, the stacking pitches of the image forming means 70 can be decreased.

The toner regulating blade 63Y is formed of a metal leaf spring fixed to a toner regulating blade attaching means 64 in the toner accommodating part 64 with the use of a screw or the like, and is extended in a direction orthogonal to the intermediate transfer belt 44 vertical stretched, that is, a substantially horizontal direction.

The distal end of the toner regulating blade 63Y is made into contact with the outer surface of the developing roller 61A around the apex thereof, with a predetermined pressure so as to regulate a thickness of the toner sticking to the outer surface of the developing roller 61 in order to form a thin toner layer having a predetermined volume and charged with a predetermined electric charge.

The part of the toner regulating blade 63Y which is made into contact with the outer peripheral surface of the developing roller 61 in the vicinity of the apex of the outer surface of the developing roller 61 is not limited to the actual distal end of the toner regulating blade 63. That is, the part made into contact therewith may be an angled part or a curved part formed by bending the toner regulating blade 63.

The toner regulating blade 63Y is located so as to have a positional relationship and a structure such that a predetermined flexion is caused when it makes contact with the outer peripheral surface of the developing roller 61Y, that is, it is located so as to make contact with the outer surface of the developing roller 61Y in the following direction from the upstream side thereof in the rotating direction thereof, that is, in the same direction as the traveling direction of the outer surface of the developing roller 61Y.

The first transfer roller 47Y is arranged in parallel with the photosensitive drum 40Y, making contact with the photosensitive drum 40Y, the intermediate transfer belt 44 being interposed therebetween.

The cleaning means 43Y in the embodiment 1, which is a brush roller composed of a metal core made of stainless steel, and, for example, conductive fibers planted on the outer surface of the core, makes contact with the outer peripheral surface of the photosensitive drum 40Y so as to remove the toner remaining on the photosensitive drum 40Y without being transferred onto the intermediate transfer belt 44. In this embodiment 1, the four image forming means 70 for printing a full color image with the use of black K, magenta M, cyan C and yellow Y are stacked one upon another in a vertical direction along the image transfer belt 44.

The endless intermediate transfer belt 44 is made of a conductive material such as polyimide or polycarbonate, and is vertically laid in an elongated form. The intermediate transfer belt 44 is wound on the drive roller 45, the driven roller 45*a* located below the drive roller 45 and the tension regulating roller 46 located between both rollers, and a suitable degree of tension is applied to the belt by the tension regulating roller 46.

The intermediate transfer belt 44 travels at a predetermined speed in the direction of the arrow 105 on the side which is made into contact with the photosensitive drum 40 as the drive roller 45 is rotated. One of the surfaces of the intermediate transfer belt 44 is made into contact with the four photosensitive drums 40 for forming color toner images of black K, magenta M, cyan C and yellow Y.

The first transfer rollers 44 which are opposed respectively to the color photosensitive drums 40K, 40C, 40M, 40Y and which are applied with predetermined voltages are arranged on the opposite side of the intermediate transfer belt 44, remote from the photosensitive drums 40, and are made into contact with the photosensitive drums 40 through the intermediary of the intermediate transfer belt 44 with a predetermined pressure.

In order to reduce the entire dimensions of the apparatus, it is required to mount the image forming means 70 each including the photosensitive drum 40, the charging means 41, the exposure means 42, the developing means 43 and the cleaning means 43, in a high density. That is, the photosensitive medium pitches among the photosensitive drums 40 is required to be set to a value which is small as possible, and the photosensitive drum 40, the charging means 41 and the exposure means 42, the developing means 60 and the cleaning means 43 which constitute each one of the developing means 70 are arranged so as to prevent them from interfering with one another.

Meanwhile, even though the apparatus as a small-sized, the volume of toner 66 accommodated in the toner accommodation part 65 is preferably large as possible.

In order to decrease the overall dimensions of the electrophotographic apparatus, it is required to decrease the pitches or the intervals of the image forming means 70 for the color toners, which are stacked one upon another, to a value which is small as possible. The developing unit front end part 68 and the exposure means 42 in the vicinity of the developing roller 61 in each developing means 60 are superposed with each other in the heightwise direction.

If toner sticks to the front end of the LED array in the exposure means 42, inferior exposure is caused, resulting in the presence of white streaks, and the image quality is lowered. Thus, it is preferable to arrange the LED array in the exposure means 42 so that its optical axis extends in a direction which is horizontal or inclined downward from the horizontal direction.

In the embodiment 1 shown in FIG. 2, the LED is arranged so that its optical axis is inclined downward at an angle of about 3 to 5 deg. from the horizontal direction. It is noted that this angle of the optical axis should not be limited to the value shown in FIG. 2. but the inclined angle may be set to a value larger the aforementioned value within such a range that it is prevented from interfering with the developing means.

Next, explanation will be made of the steps of forming a color image on a sheet in this electro-photographic apparatus in the embodiment 1. The four image forming means 70 form color images of black k, magenta M, cyan C and yellow Y. Hereinbelow, the formation of an image of yellow Y will be explained. It is noted that the same steps can be taken for formation of a color image of any of black K, magenta M and cyan C.

When the charge roller 41Y is applied thereto with a predetermined voltage, the photosensitive layer on the outer surface of the photosensitive drum 40Y is uniformly charged.

LED beams corresponding to an yellow image are irradiated onto the photosensitive drum 40Y from the exposure means 42Y, so that the photosensitive layer is exposed. In the exposed part of the photosensitive layer on the outer surface of the photosensitive drum 40Y, the charge potential drops to a value near the ground level, and accordingly, a latent image which is invisible is formed.

Toner in a thin yellow toner layer which has been formed on the outer surface of the developing roller 61Y is allowed to stick to the latent image on the photosensitive drum 40Y so as to develop the same.

The thus formed yellow toner image is transferred onto the outer surface of the intermediate transfer belt 44.

The toner remaining on the photosensitive drum 40Y which has not yet been transferred onto the intermediate transfer belt 44 is removed by the cleaning means 43Y.

Color toner images of black k, magenta M and cyan C are formed by the corresponding image forming means 70, and are then transferred onto the intermediate transfer belt 44.

The toner images on the color photosensitive drums 40K, 40M, 40C, 40Y are formed with appropriate time differences in accordance with a traveling speed of the intermediate transfer belt 44 and the intervals of the photosensitive drums 40 in the traveling direction of the intermediate transfer belt 44. These toner images are superposed with one another when they are transferred onto the intermediate transfer belt 44 on which a full color toner image is thus formed.

Then, the full color toner image formed on the intermediate transfer belt 44 is transferred onto a sheet 1.

Sheets 1 set in the sheet cassette 2 are separated one by one by the sheet separating means 3, and are fed onto the conveying path 5. Each of the sheets 1 are nipped between a pair of the rotatable conveying means 4 which are faced to each other. At least one of the conveying means 4 is a drive roller for conveying the sheet 1 at a predetermined speed in a desired direction.

The sheet 1 is moved on the conveying path 5 along the arrows 102*a*, 102*b*. When the sheet position detecting means 8 detect the leading end of the sheet 1, the register rollers 9 for positioning the sheet 1 is once stopped. In this condition, the rotation of the conveying means 4 is continued so that the leading end of the sheet 1 is pressed against the nip parts of the register rollers 9, that is, the contact parts of the opposed rollers, and accordingly, the leading end of the sheet 1 is set so as to be parallel with the axes of the register rollers 9.

The registration roller 9 is driven again with a timing with which the leading end of the sheet 1 and the position of the leading end of the toner image formed on the intermediate transfer belt 44 have a predetermined positional relationship therebetween. The second transfer roller 50 makes the outer surface of the sheet 1 into contact with the intermediate transfer belt 44 so as to transfer the toner image from the intermediate transfer belt 44 onto the sheet 1.

The sheet 1 is conveyed into the fixing means 51 so as to fix the transferred toner image on the outer surface of the sheet 1.

The sheet 3 onto which the toner sticks is heated by the fixing means 51 up to a temperature at which the toner is melted. Since the temperature of the outer surface of the fixing means 51 is about 160 deg.C., and since the melting point of the toner on the sheet 1 is about 100 deg.C., the toner can be melted in a short time during passing through the fixing means 51.

In the fixing means 51, the melted toner is pressed against so as to be made into close contact with the sheet 1 during fixing with a pressure between a pair of rollers, between a roller and a belt or the like, and thereafter the toner is self-cooled.

The sheet after completion of the fixing, is conveyed in the directions of the arrows 106*a*, 106*b* in the conveying path 5, and is discharged onto the sheet discharge tray 53 by the discharge rollers 52.

With the repetitions of the above-mentioned series steps, sheets on which color images are formed are successively obtained.

Figure 3:
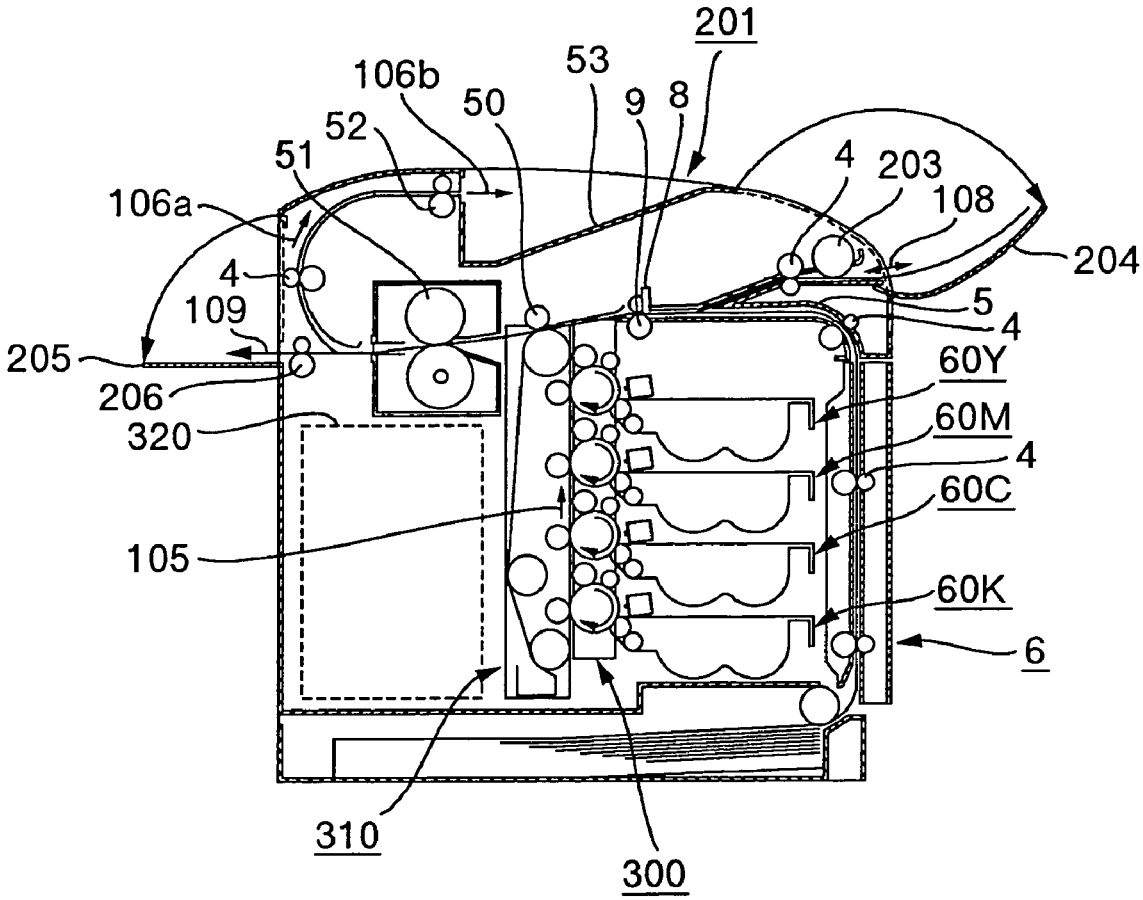
FIG. 3 is a sectional view illustrating a state during a manual sheet feed in the embodiment 1.

FIG. 3 is a sectional view illustrating a state during manual sheet feed in the embodiment 1.

In the embodiment 1, a manual sheet feed tray 204 may be laid so as to extend substantially straightforward in a horizontal direction from above the apparatus, as a second recording medium supply path.

The sheet separated by the sheet separating roller 203 incorporated in the top surface opening door 201 is fed in the direction of the arrow 108, reaches the registration rollers 9 by way of the conveying means 4, and is finally discharged on the downstream side of the fixing means 51.

Although the sheet 1 may be fed out onto the sheet discharge tray 53, by discharging the sheet in the direction of the arrow 109 from an auxiliary sheet port 205 formed in the rear surface of the electro-photographic apparatus, a substantially straight line-like sheet conveying path can be formed through the sheet supply station, the developing station and the fixing station, and accordingly, various kinds of sheets including thick sheets can be used.

Figure 4:
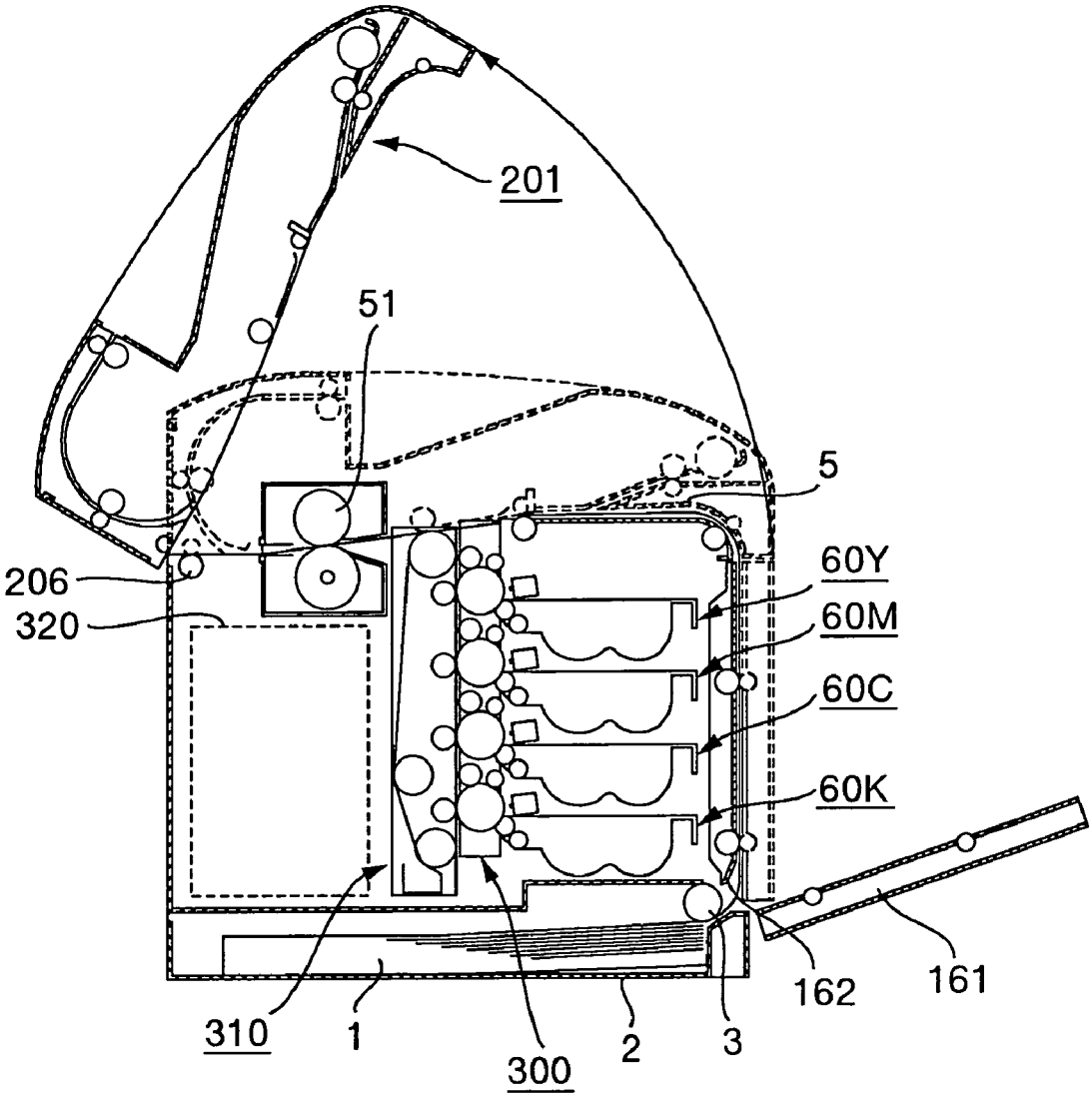
FIG. 4 is a sectional view illustrating a state during disposal of a jam of sheets in the embodiment 1.

FIG. 4 is a sectional view illustrating a state during disposal of a jam of sheets in the embodiment 1.

Disposal of a jam of sheets can e made after opening the front opening door 6 or the opt surface opening door 201.

The front opening door 6 is composed of the front side opening door 161 and the rear side opening door 162, and the sheet conveying path 5 is defined between the front side opening door 161 and the rear side opening door 162 when they are superposed with each other.

In order to dispose a jam of sheets from the front opening door 6, by opening only the front side opening door 161, the sheet conveying path is exposed, and accordingly, the disposal of a jam of sheets can be facilitated.

It is noted that the front opening door 6 should not be limited to the one in combination of the front side opening door 161 and the rear side opening door 162. If the length of the front opening door 6 is shorter than the length of the sheet 1, it may be an integral structure opening door even which the disposal of a jam of sheets can be simply made.

The top surface opening door 201 defines the sheet conveying path 5 between itself and the sheet guide provided on the opening door 201 side on the upper surface of the sheet guide provided on the casing side.

In the case of disposal of a jam of sheet from the top surface opening door 201, by simply opening the top surface opening door 201, the sheet conveying path located at the top surface of the casing is substantially exposed, the disposal of a jam of sheets can be simply made.

Figure 5:
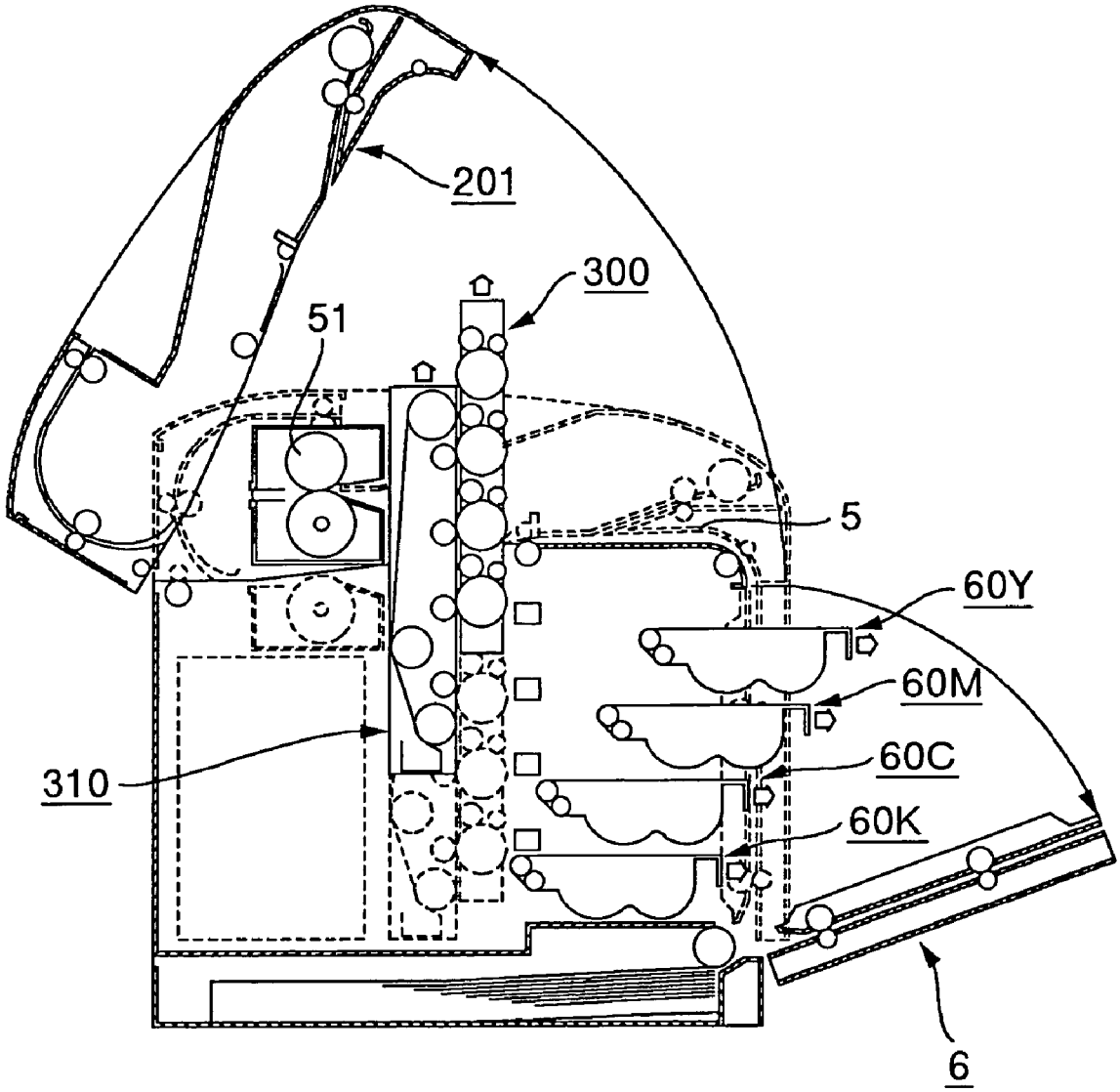
FIG. 5 is a sectional view illustrating a state during replacement of consumables or replacement of a component in the embodiment 1.

FIG. 5 is a sectional view illustrating a state during replacement consumables or replacement of components in the embodiment 1.

In the case of replacement of consumables such as toner or replacement of components to be periodically displaced, such as the photosensitive mediums, the intermediate transfer belt, the fixing means and the like, the front opening door 6 and the top surface opening door 201 are opened.

When the front opening door 6 is opened, an old developing means can be pulled out substantially straightforward in the direction of the arrow 104, and accordingly, a new developing means 60 can be installed.

Since the developing unit front end part 68 is formed in dimensions so as to prevent interference with the exposure means 42Y, 42M, the developing means 60Y, 60M and the like can be pulled out straightforward when they are removed for replacement.

Thus, the motion for straightforward pull-out or insertion is simplest, and accordingly, the working of replacement of the developing means 60 can be simplified. Thus, the electrophotographic apparatus can be easily handled.

The intermediate transfer belt unit 310 can be removed upward.

As stated in the embodiment 1, with the formation of the photosensitive medium unit in which a plurality of photosensitive media 40K, 40M, 40C, 40Y are mounted on the common support member 301, the photosensitive medium unit can be simply replaced with new one above the apparatus.

Figure 6:
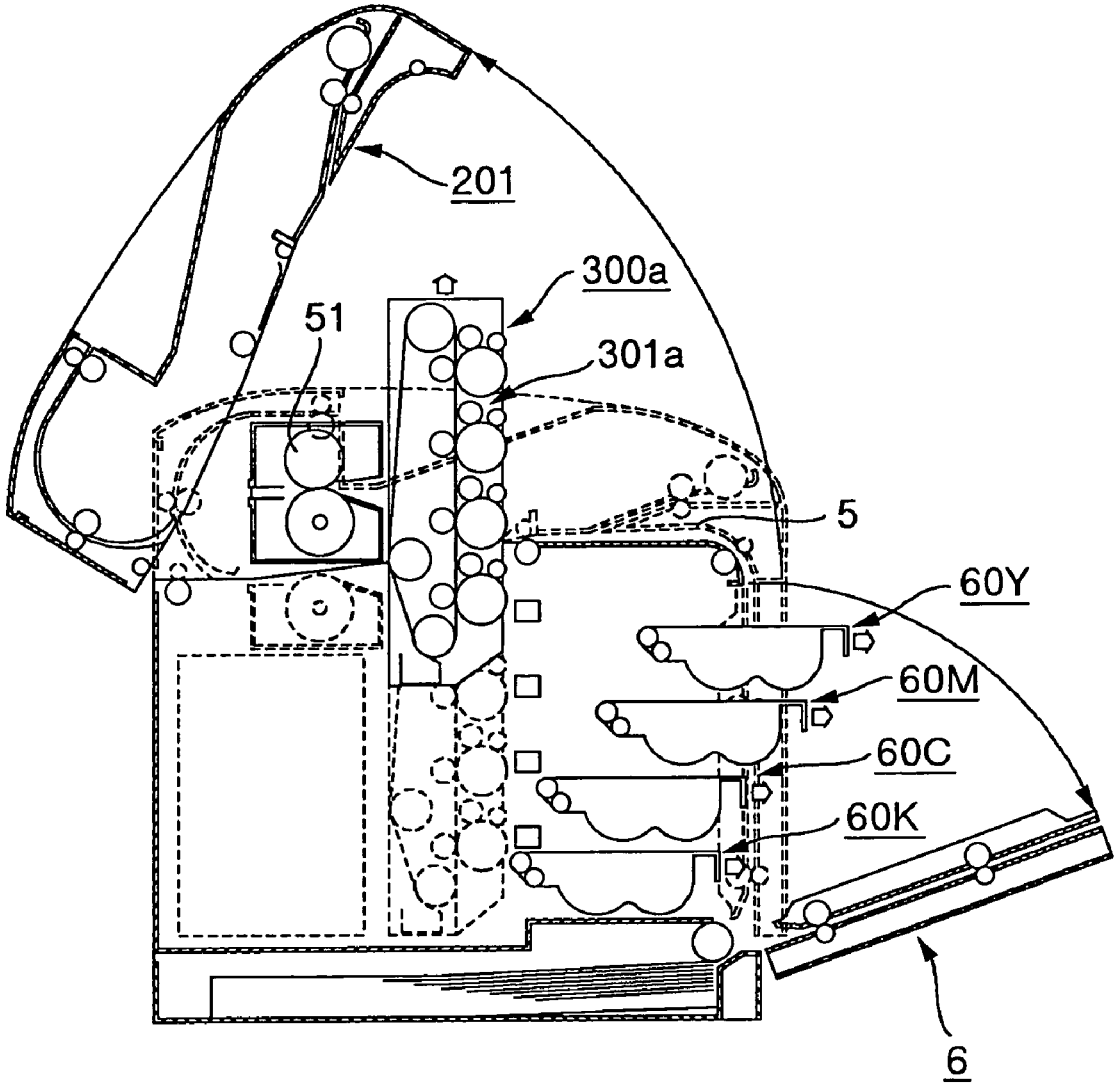
FIG. 6 is a sectional view illustrating a state during replacement of consumables or replacement of components in an embodiment 2 of the electro-photographic apparatus according to the present invention.

FIG. 6 is a sectional view illustrating a state during replacement of consumables or replacement of components in a embodiment 2 of the electro-photographic apparatus according to the present invention.

A plurality of photosensitive media 40K, 40M, 40C, 40Y may be mounted to a support member 301*a* common to the intermediate transfer belt so as to form an integral unit 300*a*.

Figure 7:
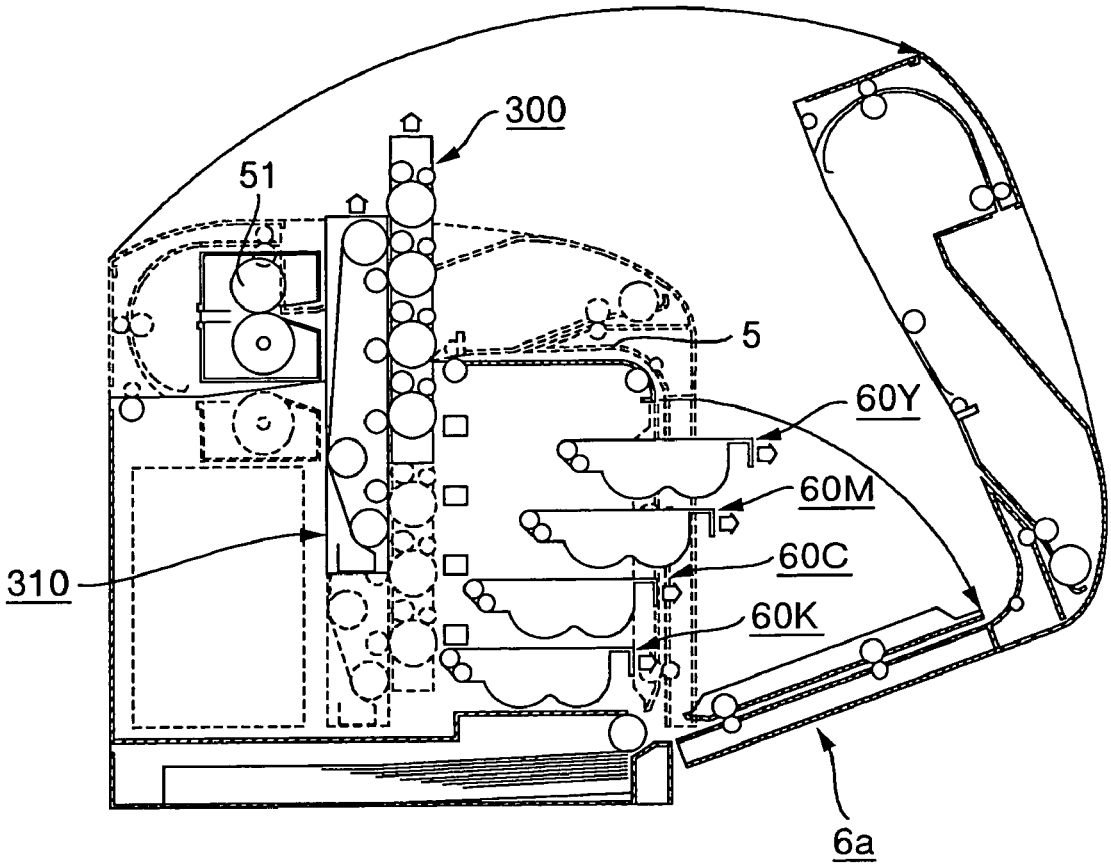
FIG. 7 is a sectional view illustrating a state during replacement of consumables or replacement of a component in an embodiment 3 of the present invention.

FIG. 7 is a sectional view illustrating a state during replacement of consumables or replacement of components in an embodiment 3 of the electro-photographic apparatus according to the present invention.

In other embodiments of the present invention, the front opening door 6 and the top surface opening door 201 are independent from each other. On the contrary, in the embodiment 3, the opening doors are integrally incorporated into an inversed L-like shape opening door 6*a*.

Thus, with the provision of the inversed L-like opening door, the vertical conveying path, the curved part and the horizontal conveying path can be exposed at once, the disposal of a jam of sheets, replacement of consumables such as toner, or components such as the photosensitive media, the intermediate transfer belt or the fixing means can be simply made.

The explanation has been made of the embodiments 1 to 3 in which the developing unit front end part 68 and the toner accommodation part 65 are integrally incorporated with each other so as to constitute a developing cartridge. The developing means 60 according to the present invention should not be limited to this configuration.

Figure 8:
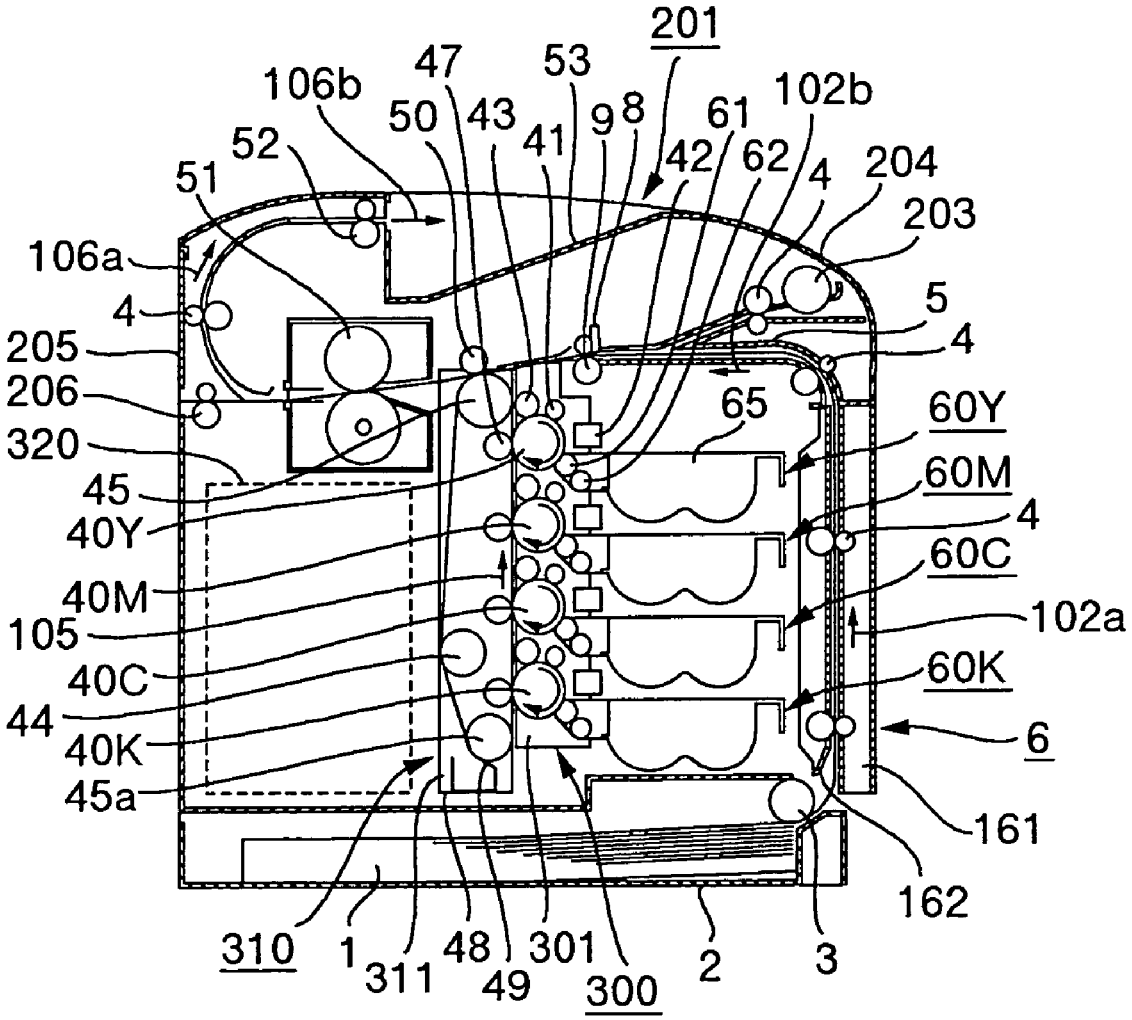
FIG. 8 is a sectional view illustrating an entire configuration of a fourth embodiment of the electrophotographic apparatus in an embodiment 4 of the present invention.
Figure 9:
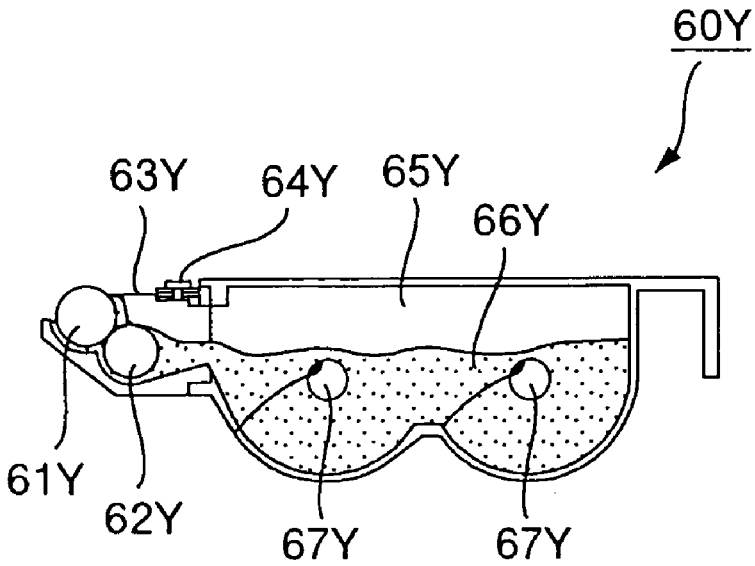
FIG. 9 is a sectional view illustrating a configuration in which developing unit front end part and a toner accommodation part can be separated from each other.
Figure 9:
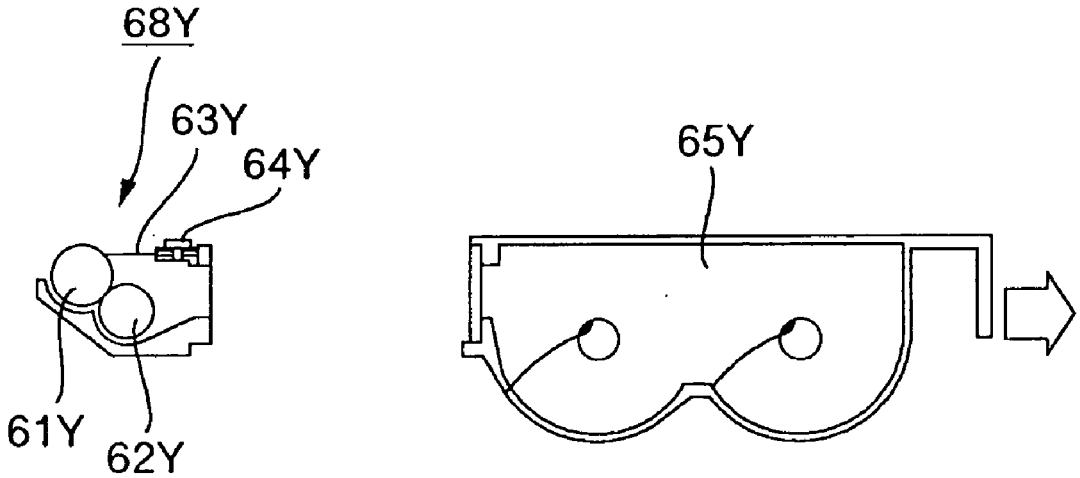
Figure 10:
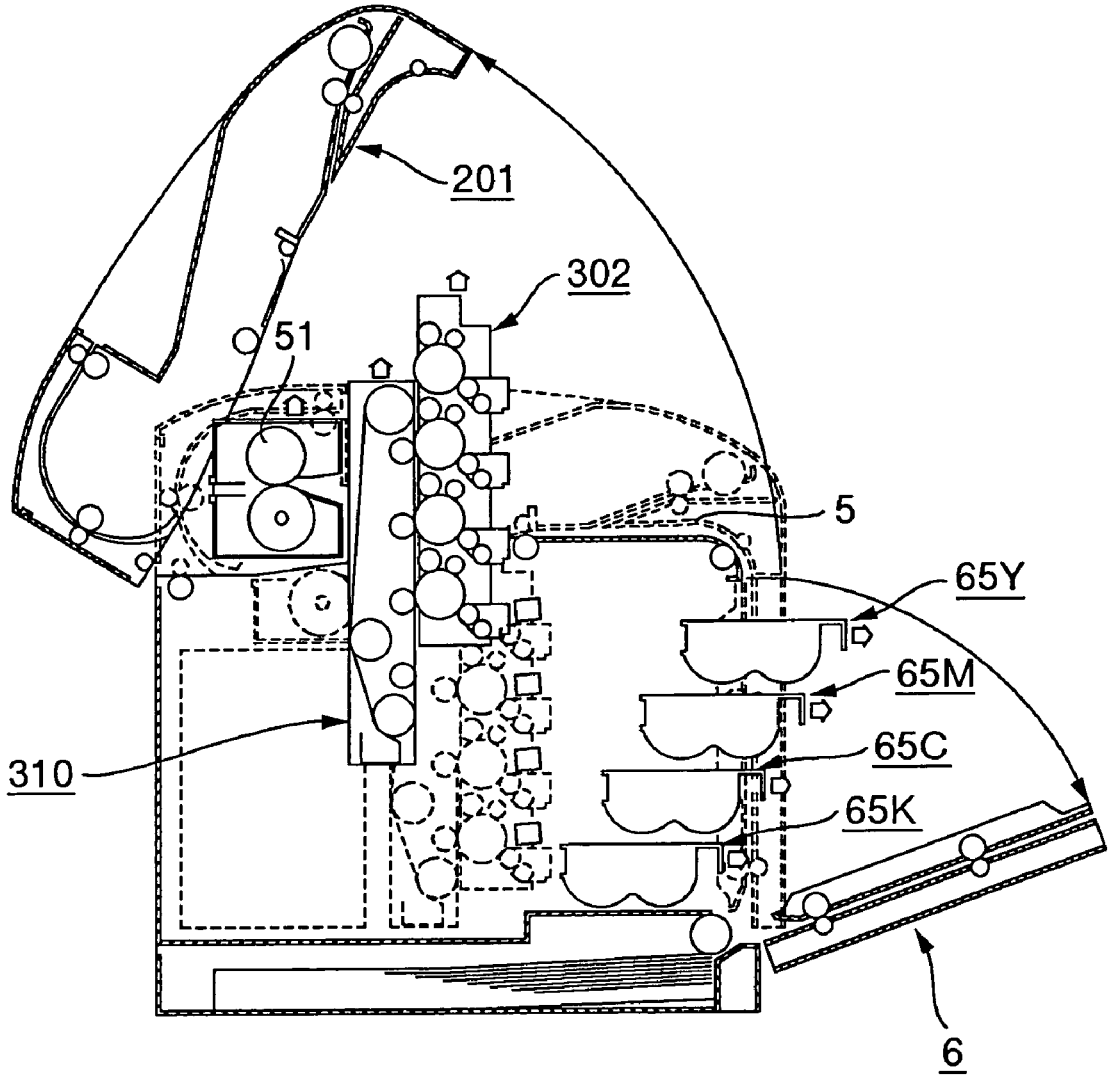
FIG. 10 is a sectional view illustrating a state during replacement of consumables or replacement of components.

FIG. 8 is a sectional view illustrating an overall configuration of an embodiment 4 of the electrophotographic apparatus according to the present invention. FIG. 9 is a sectional view illustrating a configuration in which the developing unit front end part and the toner accommodation part can be separated from each other in the embodiment 4. FIG. 10 is a sectional view illustrating a state during displacement of consumables or replacement of components in the embodiment 4.

The overall configuration of the electro-photographic apparatus in the embodiment 4 is substantially the same as that of the first embodiment.

The developing means 60 in the embodiment 4 incorporates the developing unit front end part 68Y and the toner accommodation part 65Y which are separatable from each other.

Different to the embodiment 1, in the embodiment 4, a plurality of photosensitive media 40 and a plurality of developing unit front end parts are mounted on a common support member 311 so as to constitute an integral unit 302.

If the use life of the developing means 60 and the use life of the photosensitive drum 40 are longer than the time of consumption of toner in the toner accommodation part 65, the separation between the developing unit front end part 68Y from the toner accommodation part 65Y as in the embodiment 4 can prolong the displacement intervals of the developing unit front end part including complicated mechanism parts, thereby it is possible to reduce the running costs.

Figure 11:
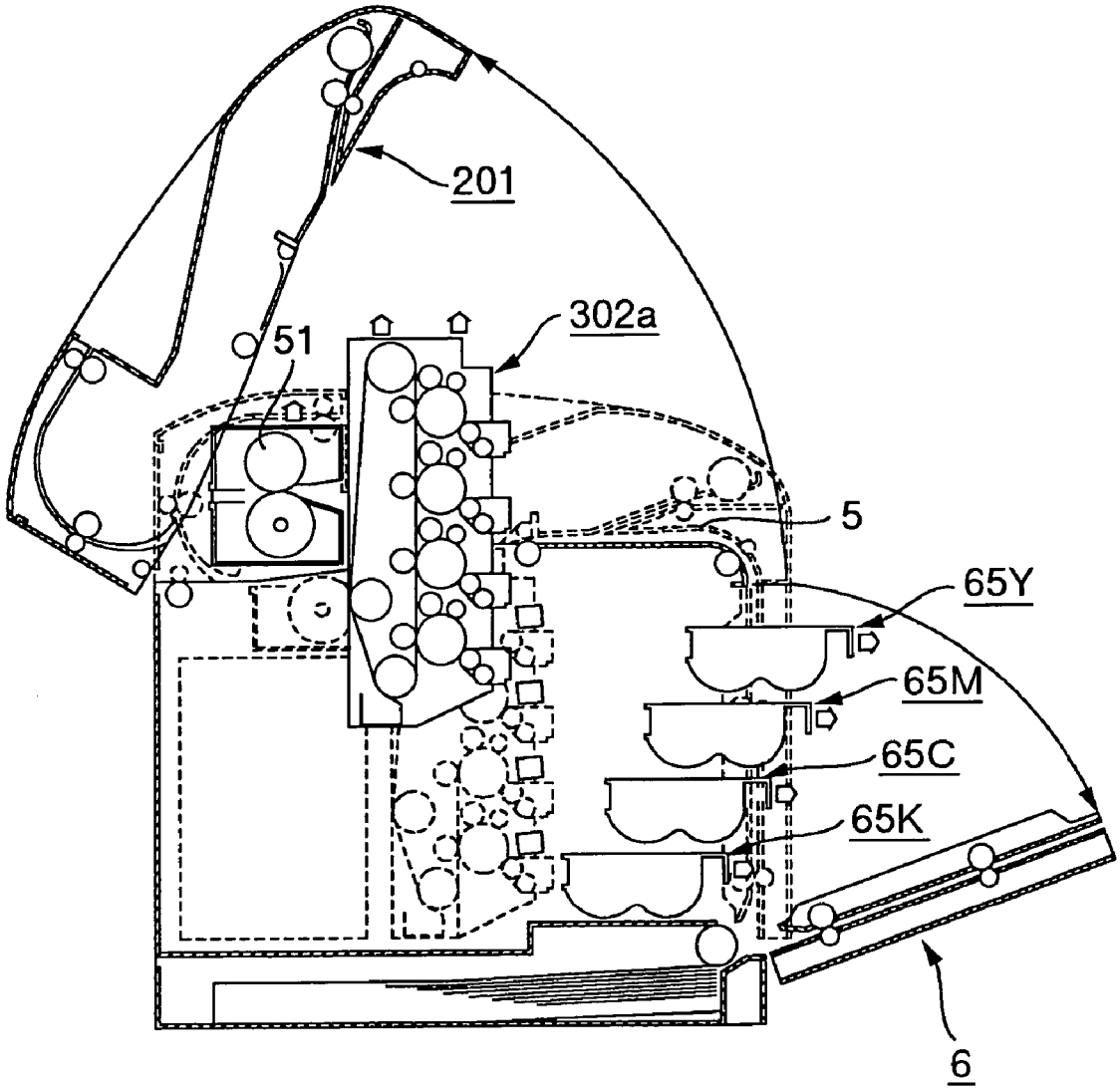
FIG. 11 is a sectional view illustrating a state during replacement of consumable or replacement of components in an embodiment 5 of the electro-photographic apparatus of the present invention.

FIG. 11 is a sectional view illustrating a state during replacement of consumables or replacement of components in an embodiment 5 of the electro-photographic apparatus according to the present invention.

A plurality of photosensitive media 40 and a plurality of developing unit front end parts 68 may be integrally incorporated with one another so as to constitute a unit 302*a*.

In the embodiment 1 to 5, although LEDs are used as the exposure means, the present invention should not be limited to this configuration.

Figure 12:
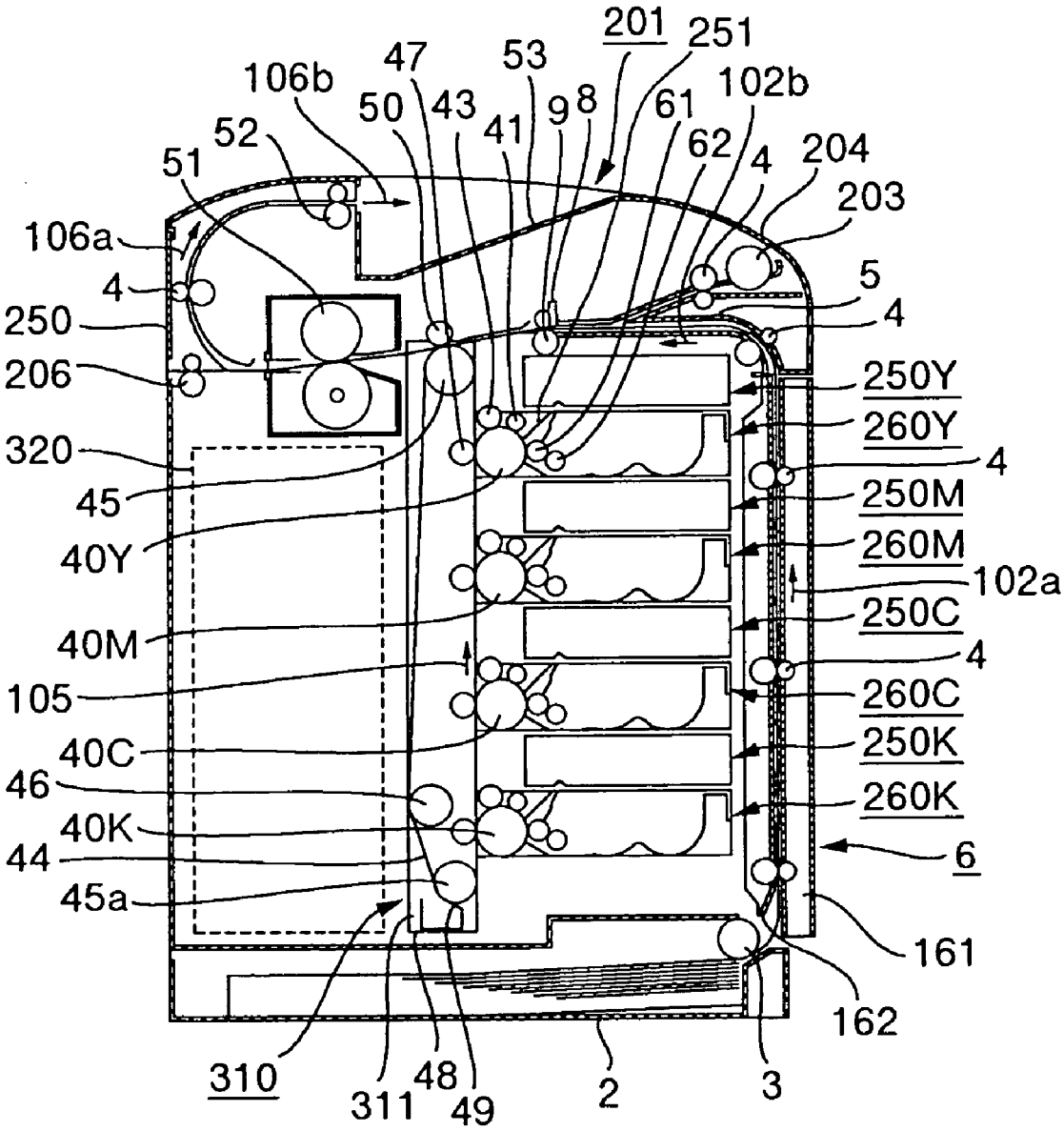
FIG. 12 is a sectional view illustrating an entire configuration of an embodiment 6 of the electrophotographic apparatus according to the present invention.

FIG. 12 is a sectional view illustrating the overall configuration of an embodiment 6 of the electrophotographic apparatus according to the present invention.

A laser beam 251 emitted from a laser source which is not shown, is reflected by a rotary polygon mirror which is rotated at a high speed by a motor 252Y so as to be turned into a scanning beam. The laser beam 251 is refracted during passing through an fθ lens so that isometric angle scanning after the reflection by the rotary polygon mirror is turned into a constant speed scanning on the outer surface of the photo-sensitive medium. The laser beam 251 is reflected by a reflector 255Y for adjusting an optical path length and an incident direction, and is then incident upon the photosensitive drum 40Y for exposure.

By using the laser scanning exposure means as the exposure means, although the size of the exposure means itself would become greater than that of the LED array, the freedom of arrangement of elements around the photosensitive drum can become higher since the exposure means can be located distant from the photosensitive drum.

Figure 13:
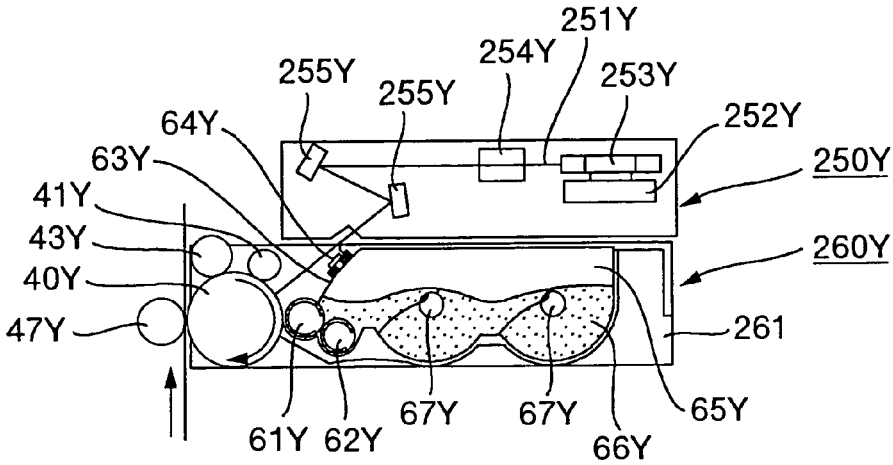
FIG. 13 is a sectional view illustrating a configuration of a laser scanning exposure means and a process cartridge in the embodiment 6.

FIG. 13 is a sectional view illustrating a structure of a laser scanning exposure means and a process cartridge in an embodiment 6.

In the embodiment 6, the photosensitive drum 40 is also mounted on the common support member 261 in addition to the developing unit front end part 68 and the toner accommodation part 65 so as to constitute an integral process cartridge which can be therefore removed without interference with the exposure means.

Figure 14:
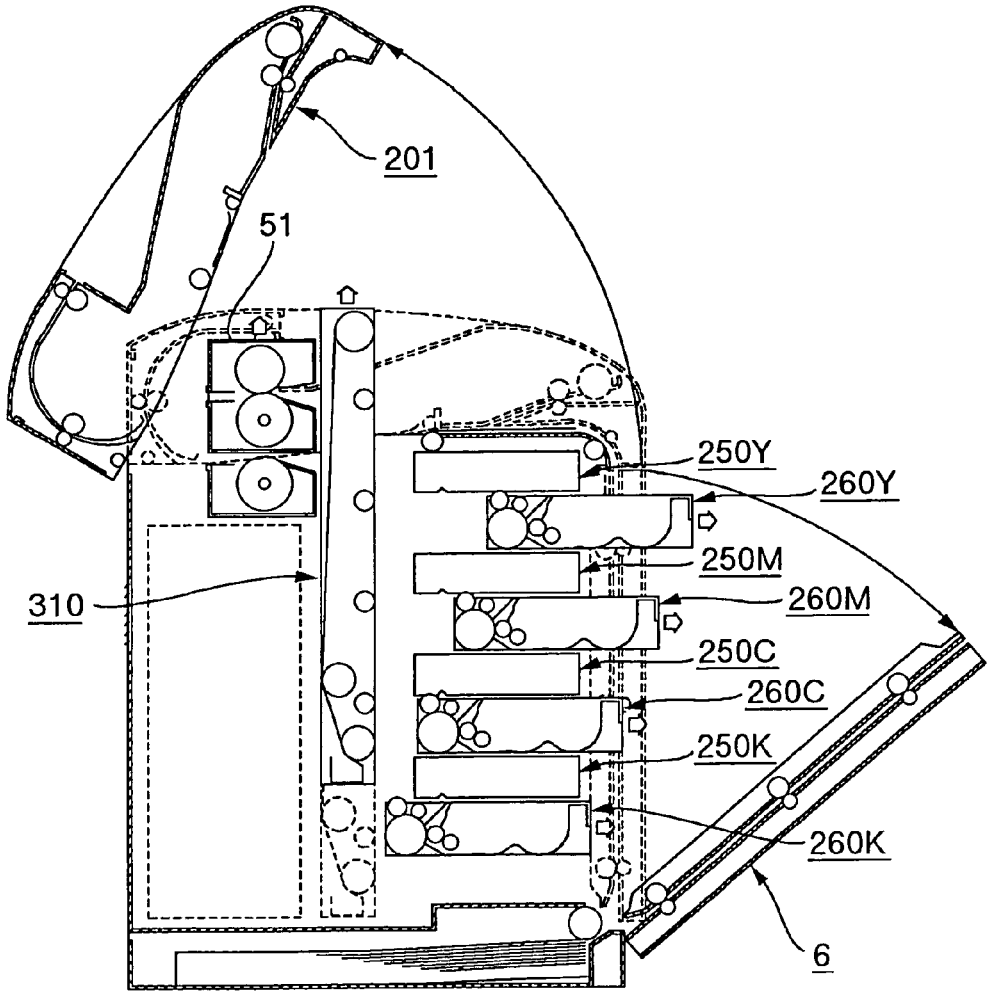
FIG. 14 is a sectional view illustrating a state during replacement of consumables or replacement of components in the embodiment 6.

FIG. 14 is a sectional view which shows a state during replacement of consumables or replacement of components in the embodiment 6. That is, FIG. 14 is a sectional view which shows an opening state of the front opening door 6 and the top surface opening door 201 when the consumables such as toner are replaced, or when a component to be periodically replaced, such as a photosensitive medium, an intermediate transfer belt, a fixing means or the like is replaced with new one.

The process cartridge can be removed in a substantially horizontal direction toward the front opening door without interference with the laser exposure means 250.

With the embodiments as stated above, in a tandem type color printer using an intermediate transfer belt, the high density mounting can be made for miniaturization of the apparatus.

Further, the disposal of a jam of sheets, the replacement of consumables and the replacement of components can be made from the front opening door and the top surface opening door, the manipulatability of the electrophotographic apparatus can be enhanced.

According to the present invention, maintenance including the disposal of a jam of sheets, the replacement of consumables including toner, the replacement of components to be periodically replaced, including a photosensitive medium, can be made from the front opening door and the top surface opening door, thereby it is possible to obtain a small-sized electrophotographic apparatus which is highly manipulatable.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A electrophotographic apparatus comprising a plurality of image forming means each including a photosensitive drum having, on its outer surface, a photosensitive layer, a charging means for charging the photosensitive layer to a predetermined potential, an exposure means for exposing the photosensitive layer in accordance with image data so as to form a latent image, and a developing means for causing toner to stick to the latent image on the outer photosensitive drum so as to form a toner image, the plurality of the image forming means being stacked one upon another along a straight part of an endless intermediate transfer belt which is stretched for rotation between a plurality of rollers including a drive roller and at least one idle roller, so as to make the photosensitive drums into contact with an outer peripheral surface of the endless belt in order to transfer toner images formed on the plurality of photosensitive drum onto a medium directly or by way of the intermediate transfer belt for forming a color image, characterized in that:

the photosensitive drums are arranged in one row in a vertical direction, the intermediate transfer belt is located on one side of the row of the photosensitive drums, the developing means are located on the other side of the row of the photosensitive drums, a recording medium supply means is located below the row of the photosensitive drums, a transfer means for transferring a toner image from the intermediate transfer belt onto the recording medium is located above the row of the photosensitive drums, a recording medium supply path composed of a vertical conveying path for conveying a recording medium fed from the recording medium supply means, substantially in parallel with the straight part outside of the developing means, a curved part and a horizontal conveying path for conveying the recording medium up to the transfer means in a substantially horizontal direction is provided, and a second recording medium supply means is incorporated on the upstream side of the horizontal conveying path, substantially above the curved part, and an auxiliary sheet discharge port is located on the downstream side thereof.

2. An electrophotographic apparatus comprising a plurality of image forming means each including a photosensitive drum having, on its outer surface, a photosensitive layer, a charging means for charging the photosensitive layer to a predetermined potential, an exposure means for exposing the photosensitive layer in accordance with image data so as to form a latent image, and a developing means for causing toner to stick to the latent image on the outer photosensitive drum so as to form a toner image, the plurality of the image forming means being stacked one upon another along a straight part of an endless intermediate transfer belt which is stretched for rotation between a plurality of rollers including a drive roller and at least one idle roller, so as to make the photosensitive drums into contact with an outer peripheral surface of the endless belt in order to transfer toner images formed on the plurality of photosensitive drum onto a medium directly or by way of the intermediate transfer belt for forming a color image, characterized in that:

the photosensitive drums are arranged in one row in a vertical direction, the intermediate transfer belt is located on one side of the row of the photosensitive drums, the developing means are located on the other side of the row of the photosensitive drums, a recording medium supply means is located below the row of the photosensitive drums, a transfer means for transferring a toner image from the intermediate transfer belt onto the recording medium is located above the row of the photosensitive drums, a recording medium supply path composed of a vertical conveying path for conveying a recording medium fed from the recording medium supply means, substantially in parallel with the straight part outside of the developing means, a curved part and a horizontal conveying path for conveying the recording medium up to the transfer means in a substantially horizontal direction is provided, and the horizontal conveying path incorporates a top surface opening door for exposing this conveying path.

3. An electrophotographic apparatus comprising a plurality of image forming means each including a photosensitive drum having, on its outer surface, a photosensitive layer, a charging means for charging the photosensitive layer to a predetermined potential, an exposure means for exposing the photosensitive layer in accordance with image data so as to form a latent image, and a developing means for causing toner to stick to the latent image on the outer photosensitive drum so as to form a toner image, the plurality of the image forming means being stacked one upon another along a straight part of an endless intermediate transfer belt which is stretched for rotation between a plurality of rollers including a drive roller and at least one idle roller, so as to make the photosensitive drums into contact with an outer peripheral surface of the endless belt in order to transfer toner images formed on the plurality of photosensitive drum onto a medium directly or by way of the intermediate transfer belt for forming a color image, characterized in that:

the photosensitive drums are arranged in one row in a vertical direction, the intermediate transfer belt is located on one side of the row of the photosensitive drums, the developing means are located on the other side of the row of the photosensitive drums, a recording medium supply means is located below the row of the photosensitive drums, a transfer means for transferring a toner image from the intermediate transfer belt onto the recording medium is located above the row of the photosensitive drums, a recording medium supply path composed of a vertical conveying path for conveying a recording medium fed from the recording medium supply means, substantially in parallel with the straight part outside of the developing means, a curved part and a horizontal conveying path for conveying the recording medium up to the transfer means in a substantially horizontal direction is provided, and the vertical conveying path, the curved part and the horizontal conveying path incorporate an inversed L-like opening door for exposing the conveying paths.

4. An electrophotographic apparatus as set forth in claim 1 or 2, characterized in that the vertical conveying path incorporates a front opening door for exposing the conveying path.

5. An electrophotographic apparatus as set forth in claim 1, characterized in that the exposure means incorporates an LED light source.

6. An electrophotographic apparatus as set forth in claims 2 or 3, characterized in that at least the plurality of the photosensitive drum are mounted on a common support member so as to constitute an integral unit which can be removed upward.

7. An electrophotographic apparatus as set forth in claims 2 or 3, characterized in that the intermediate transfer belt can be removed upward.

8. An electrophotographic apparatus as set forth in claims 2 or 3, characterized in that the intermediate transfer belt and at least the plurality of photosensitive drums are mounted on a common support member so as to constitute an integral unit which can be removed upward.

9. An electrophotographic apparatus as set forth in claim 2, characterized in that a fixing means for heating the toner image transferred on the recording medium so as to fix the same on the recording medium is incorporated in the horizontal conveying path downstream of the transfer means and can be removed upward.

10. An electrophotographic apparatus as set forth in claim 1, characterized in that an accommodation space for accommodating at least one of a power source unit and a drive circuit is defined outside of the intermediate transfer belt.

11. An electrophotographic apparatus as set forth in claim 1, characterized in that the horizontal conveying path incorporates a top surface opening door for exposing this conveying path.

12. An electrophotographic apparatus comprising a plurality of image forming means each including a photosensitive drum having, on its outer surface, a photosensitive layer, a charging means for charging the photosensitive layer to a predetermined potential, an exposure means for exposing the photosensitive layer in accordance with image data so as to form a latent image, and a developing means for causing toner to stick to the latent image on the outer photosensitive drum so as to form a toner image, the plurality of the image forming means being stacked one upon another along a straight part of an endless intermediate transfer belt which is stretched for rotation between a plurality of rollers including a drive roller and at least one idle roller, so as to make the photosensitive drums into contact with an outer peripheral surface of the endless belt in order to transfer toner images formed on the plurality of photosensitive drum onto a medium directly or by way of the intermediate transfer belt for forming a color image, characterized in that:

the photosensitive drums are arranged in one row in a vertical direction, the intermediate transfer belt is located on one side of the row of the photosensitive drums, the developing means are located on the other side of the row of the photosensitive drums, a recording medium supply means is located below the row of the photosensitive drums, a transfer means for transferring a toner image from the intermediate transfer belt onto the recording medium is located above the row of the photosensitive drums, a recording medium supply path composed of a vertical conveying path for conveying a recording medium fed from the recording medium supply means, substantially in parallel with the straight part outside of the developing means, a curved part and a horizontal conveying path for conveying the recording medium up to the transfer means in a substantially horizontal direction is provided, the vertical conveying path incorporates a front opening door for exposing the conveying path, the developing means is composed of a developing unit front end part including a developing roller made into contact with the photosensitive drum so as to be rotated in order to form a thin toner layer on the outer surface of the photosensitive drum, a supply roller for feeding toner onto the developing roller and a toner regulating blade made into line-like contact with the outer peripheral surface of the developing roller with a predetermined pressure so as to form a thin toner layer on the outer surface of the developing layer, and a toner accommodation part coupled to the developing unit front end part, for accommodating therein toner, the developing unit front end part and the toner accommodation part form an integral developing cartridge, and the developing cartridge is removed from the opening door side for exposing the vertical conveying path.

13. An electrophotographic apparatus comprising a plurality of image forming means each including a photosensitive drum having, on its outer surface, a photosensitive layer, a charging means for charging the photosensitive layer to a predetermined potential, an exposure means for exposing the photosensitive layer in accordance with image data so as to form a latent image, and a developing means for causing toner to stick to the latent image on the outer photosensitive drum so as to form a toner image, the plurality of the image forming means being stacked one upon another along a straight part of an endless intermediate transfer belt which is stretched for rotation between a plurality of rollers including a drive roller and at least one idle roller, so as to make the photosensitive drums into contact with an outer peripheral surface of the endless belt in order to transfer toner images formed on the plurality of photosensitive drum onto a medium directly or by way of the intermediate transfer belt for forming a color image, characterized in that:

the photosensitive drums are arranged in one row in a vertical direction, the intermediate transfer belt is located on one side of the row of the photosensitive drums, the developing means are located on the other side of the row of the photosensitive drums, a recording medium supply means is located below the row of the photosensitive drums, a transfer means for transferring a toner image from the intermediate transfer belt onto the recording medium is located above the row of the photosensitive drums, a recording medium supply path composed of a vertical conveying path for conveying a recording medium fed from the recording medium supply means, substantially in parallel with the straight part outside of the developing means, a curved part and a horizontal conveying path for conveying the recording medium up to the transfer means in a substantially horizontal direction is provided, the vertical conveying path incorporates a front opening door for exposing the conveying path, the developing means is composed of a developing unit front end part including a developing roller made into contact with the photosensitive drum so as to be rotated in order to form a thin toner layer on the outer surface of the photosensitive drum, a supply roller for feeding toner onto the developing roller and a toner regulating blade made into line-like contact with the outer peripheral surface of the developing roller with a predetermined pressure so as to form a thin toner layer on the outer surface of the developing layer, and a toner accommodation part coupled to the developing unit front end part, for accommodating therein toner, the developing unit front end part and the toner accommodation part are configured so as to be separatable from each other, and only the toner accommodation part is removed from the opening door side for exposing the vertical conveying path.

14. An electrophotographic apparatus as comprising a plurality of image forming means each including a photosensitive drum having, on its outer surface, a photosensitive layer, a charging means for charging the photosensitive layer to a predetermined potential, an exposure means for exposing the photosensitive layer in accordance with image data so as to form a latent image, and a developing means for causing toner to stick to the latent image on the outer photosensitive drum so as to form a toner image, the plurality of the image forming means being stacked one upon another along a straight Dart of an endless intermediate transfer belt which is stretched for rotation between a plurality of rollers including a drive roller and at least one idle roller, so as to make the photosensitive drums into contact with an outer peripheral surface of the endless belt in order to transfer toner images formed on the plurality of photosensitive drum onto a medium directly or by way of the intermediate transfer belt for forming a color image, characterized in that:

the photosensitive drums are arranged in one row in a vertical direction, the intermediate transfer belt is located on one side of the row of the photosensitive drums, the developing means are located on the other side of the row of the photosensitive drums, a recording medium supply means is located below the row of the photosensitive drums, a transfer means for transferring a toner image from the intermediate transfer belt onto the recording medium is located above the row of the photosensitive drums, a recording medium supply path composed of a vertical conveying path for conveying a recording medium fed from the recording medium supply means, substantially in parallel with the straight part outside of the developing means, a curved part and a horizontal conveying path for conveying the recording medium up to the transfer means in a substantially horizontal direction is provided, the vertical conveying path incorporates a front opening door for exposing the conveying path, the developing means is composed of a developing unit front end part including a developing roller made into contact with the photosensitive drum so as to be rotated in order to form a thin toner layer on the outer surface of the photosensitive drum, a supply roller for feeding toner onto the developing roller and a toner regulating blade made into line-like contact with the outer peripheral surface of the developing roller with a predetermined pressure so as to form a thin toner layer on the outer surface of the developing layer, and a toner accommodation part coupled to the developing unit front end part, for accommodating therein toner, and at least the developing unit front end part, the toner accommodation part and the photosensitive drum constitute an integral process cartridge which can be removed from the opening door side for exposing the vertical conveying path.

15. An electrophotographic apparatus as set forth in claim 14, characterized in that the exposure means incorporates a laser source.

16. An electrophotographic apparatus as set forth in claim 14, characterized in that the intermediate transfer belt can be removed upward.

* * * * *